US005553393A

United States Patent [19]

Korhonen et al.

[11] Patent Number: 5,553,393

[45] Date of Patent: Sep. 10, 1996

[54] DRYER SECTION OF A PAPER MACHINE INCLUDING CYLINDER GROUPS WITH SINGLE-WIRE DRAW

[75] Inventors: Ville Korhonen, Jyväskylä ; Allan Liedes, Palokka; Jouko Yli-Kauppila, Muurame,all of Finland

[73] Assignee: Valmet Corporation, Helsinki, Finland

[21] Appl. No.: 410,090

[22] Filed: Mar. 24, 1995

[30] Foreign Application Priority Data

Mar. 25, 1994 [FI] Finland ..... 941392

[51] Int. Cl.[6] ..... F26B 11/02

[52] U.S. Cl. ..... 34/117; 34/111; 34/454; 162/207

[58] Field of Search ..... 34/111, 112, 114–17, 34/123, 454, 456, 458; 162/207, 358.5

[56] References Cited

U.S. PATENT DOCUMENTS

| | | | |
|---|---|---|---|
| 4,361,466 | 11/1982 | Wong et al. | 162/207 |
| 4,378,639 | 4/1983 | Walker | 162/207 |
| 4,441,263 | 4/1984 | Vedenpaa | 34/115 |
| 4,502,231 | 3/1985 | Fissmann et al. | 34/114 |
| 4,516,330 | 5/1985 | Eskelinen et al. | 34/23 |
| 4,661,198 | 4/1987 | Simmonds, Jr. et al. | 156/578 |
| 4,882,855 | 11/1989 | Loser et al. | 34/116 |
| 4,905,380 | 3/1990 | Eskelinen et al. | 34/23 |
| 4,982,513 | 1/1991 | Loser et al. | 34/116 |
| 5,022,163 | 6/1991 | Ilvespaa et al. | 34/23 |
| 5,241,761 | 9/1993 | Hauser | 34/117 |
| 5,279,050 | 1/1994 | Tormanen | 34/117 |

FOREIGN PATENT DOCUMENTS

| | | |
|---|---|---|
| 83441 | 3/1991 | Finland . |
| 92297 | 1/1896 | Germany . |

*Primary Examiner*—John M. Sollecito
*Assistant Examiner*—Steve Gravini
*Attorney, Agent, or Firm*—Steinberg, Raskin & Davidson, P.C.

[57] ABSTRACT

A dryer section of a paper machine including cylinder groups provided with single-wire draw having smooth-faced heated drying cylinders against which a web to be dried enters into direct contact, and reversing rolls. The groups with single-wire draw have a drying wire which is guided in a loop by guide rolls as well as by the drying cylinders and the reversing rolls so that the drying cylinders are placed outside the wire loop, and the reversing rolls are situated in gaps between the drying cylinders inside the drying-wire loop. In order to optimize the drying capacity calculated per unit of length of the dryer section in the machine direction, as the drying makes progress, a different ratio of the drying cylinder diameter to the reversing roll diameter is employed, so that, in the first group or groups in the initial end of the dryer section, the ratio is higher than the corresponding ratio in the groups in the middle area of the dryer section. In the group or groups in the final end of the dryer section, a diameter ratio is used that is higher than the ratio in the middle area of the dryer section.

21 Claims, 4 Drawing Sheets

DRYER SECTION OF A PAPER MACHINE INCLUDING CYLINDER GROUPS WITH SINGLE-WIRE DRAW

BACKGROUND OF THE INVENTION

The present invention relates to a dryer section of a paper machine including cylinder groups provided with single-wire draw which comprise a plurality of heated drying cylinders having smooth faces against which a paper web to be dried enters into direct contact, and reversing rolls. The single-wire draw groups have a drying wire which is guided in a loop by guide rolls as well as by the drying cylinders and reversing rolls such that the drying cylinders are arranged outside the wire loop, and the reversing rolls are arranged in gaps between the drying cylinders and inside the drying-wire loop. The present invention also relates to a method for drying a web in a dryer section.

As known in the prior art, in multi-cylinder dryers of paper machines, twin-wire draw and/or single-wire draw is/are employed in dryer groups. In a twin-wire draw dryer group, there are two wires which press the web, one from above and the other one from below, against the heated cylinder faces of the drying cylinders. In twin-wire draw, between the rows of drying cylinders, which are usually horizontal rows, the web has free and unsupported draws, which are susceptible of fluttering leading to web breaks, in particular in the stages of the drying in which the web is still relatively moist and, therefore, of low strength. For this reason, in recent years, increasing use has been made of the single-wire draw, in which each group of drying cylinders has only one drying wire on whose support the web runs through the entire group so that the drying wire presses the web on the drying cylinders against the heated cylinder faces, whereas, on the reversing cylinders or rolls between the drying cylinders, the web remains at the side of the outside curve. Thus, in single-wire draw, the drying cylinders are placed outside the wire loop and the reversing cylinders or rolls are situated inside the wire loop. From the prior art, dryer sections are known that consist exclusively of so-called normal groups with single-wire draw, in which groups the drying cylinders are placed in a first, upper row and the reversing cylinders or rolls are placed in a second, lower row below the first row.

In a dryer section that consists of normal groups with single-wire draw alone, it is a drawback that the paper web is dried from the side of its lower face alone, which may cause a tendency of curling in the web. Therefore, it is known in the prior art when drying a paper web, to use a dryer section in which there are, for example, alternatingly so-called normal groups and inverted groups with single-wire draw. In an inverted group with single-wire draw, the drying cylinders are situated in a first, lower row and the reversing cylinders or rolls are situated in a second, upper row above the first row of drying cylinders.

Also, dryer sections are known in which all the other groups except the last group are normal groups with single-wire draw, whereas the last group is a group with twin-wire draw.

In the dryer sections mentioned above, various problems have occurred, for which problems the present invention provides novel and efficient solutions. These problems include the large length of the dryer section, which increases the costs of the dryer section and of the machine hall. Problems have also been encountered in the runnability of the dryer section and in the threading of the web, as well as those problems which arise from differences in the speeds of different wires and problems related to the control of transverse shrinkage of the web. Generally, these problems tend to become worse as the running speed of the paper machine becomes higher.

In prior art dryer-section constructions, the overall length of the dryer section is often considerably large, which results in an increase in the cost of investment of a paper mill, above all the construction cost. If it were possible to reduce the length of the dryer section, it would also be possible to reduce the construction cost of the paper mill in the same proportion.

Regarding the prior art related to the present invention, reference is made initially to Finnish Patent Application No. 913648 (corresponding to U.S. Pat. No. 5,279,050, the specification of which is hereby incorporated by reference herein). In the dryer section described in this Finnish patent application, drying cylinders of two different diameters and reversing cylinders of two different diameters are used, of which cylinders the drying cylinders with larger diameter are placed in an uppermost first, horizontal level, and a reversing cylinder is placed in each gap between every other pair of upper drying cylinders and the drying cylinders of smaller diameter, placed in gaps between every other pair of cylinders, are situated in the next, lower second horizontal level. The last-mentioned reversing cylinders and drying cylinders have substantially equal diameters. In the lowest, third level, reversing cylinders of smaller diameter are placed in pairs at both sides of the gap between every other pair of upper drying cylinders, a drying cylinder of smaller diameter being placed above, and in the middle of, the gap between the pair of lower reversing cylinders. A drawback of the dryer section of this patent application is that the drying cylinders and the reversing cylinders are placed at quite a large difference in height in relation to one another, so that servicing of the machine from one tending platform is difficult, and that, for the machine, both drying cylinders of two different diameters and reversing cylinders of two different diameters are needed. This increases the costs of manufacture, servicing and spare parts of the dryer section.

With respect to the prior art, reference is also made to Finnish Patent No. 83,441, in which it is suggested that, over the length of the dryer section, different wire tensions be employed in the different groups, preferably so that, when the dry solids content becomes higher, the wire tension is increased. However, in this manner, the drying capacity cannot be influenced so efficiently, and a further drawback of this technique is that large-diameter guide rolls are required in order to obtain high wire tensions. The concept of this Finnish patent can, however, be used favorably in connection with the present invention.

With respect to the prior art closely related to the present invention, reference is made further to U.S. Pat. Nos. 4,882,855, 4,982,513 and 5,241,761 assigned to J. M. Voith GmbH). Of these patents, U.S. Pat. No. 4,882,855 describes a dryer section in which there are, in the direction of progress of the web, initially drying cylinders of constantly increasing diameters, after which there are, in the direction of progress of the web, drying cylinders having a constantly decreasing diameters. It is a drawback of this dryer section construction that the costs of manufacture, servicing and spare parts of the dryer section become very high because of the number of different diameters of the drying cylinders. A further drawback is that there are open draws of the web between the rows of drying cylinders.

In U.S. Pat. No. 4,982,513, a dryer section is described which consists of a number of successive groups with single-wire draw, which groups are alternatingly so-called normal and inverted groups. In the initial end of the dryer section, obviously drying cylinders of normal size are used, for example, in the first two groups, and thereafter, in the following two groups, cylinders larger than the normal size are used. Then, in the following wire groups, in the direction of progress of the web, drying cylinders of successively smaller diameters are used. The reversing suction rolls placed between the drying cylinders are rolls of equal diameter in all the groups. It is a drawback of this construction that cylinders of at least four different diameters are used, and that the cylinder diameters are not arranged so that they are distributed optimally in view of the drying capacity in the direction of progress of the web.

In U.S. Pat. No. 5,241,761, a dryer section is described which consists of a number of successive groups with single-wire draw arranged in such a way that, in the initial end of the dryer section, in the single-wire groups, small-diameter reversing suction rolls with an inside or interior suction box are used, and in the wire groups in the rear end of the dryer section, cylinders of larger diameter and with grooved mantles are used. These large-diameter grooved-mantle cylinders resemble the suction cylinders which are marketed under the trade mark "VAC-ROLL"™, which have no inside suction boxes, and which are described in Finnish Patent No. 83,680 (corresponding U.S. Pat. No. 5,022,163, the specification of which is hereby incorporated by reference herein). In the dryer section described in U.S. Pat. No. 5,241,761, drying cylinders of just one diameter are employed.

OBJECTS AND SUMMARY OF THE INVENTION

The following drawings are illustrative of embodiments of the invention and are not meant to limit the scope of the invention as encompassed by the claims.

An object of the present invention is further development of the prior art dryer sections described above so that the drawbacks discussed above can be substantially eliminated.

It is another object of the present invention to provide a novel dryer section geometry in which its different parts are dimensioned so that a maximal drying capacity is obtained while, nevertheless, maintaining good runnability of the dryer section.

It is also an object of the present invention to provide a novel dryer section for a paper machine, which is to some extent shorter than prior art dryer sections that have an equivalent drying capacity and an equal number of cylinders.

It is still another object of the present invention to provide a novel dryer section that can also be applied to modernizations of existing paper machines, so that the drying capacity thereof can be increased, for example, in connection with an increase in the running speed of the paper machine or in connection with a change of the paper grade to be produced. It is a typical example of a change of paper grade that a surface-sizing device is arranged in the final end of the dryer section, together with the finishing-dryer necessary after it. Thus, it is an object of the invention to provide a novel dryer section that is suitable for this purpose and by whose means the dryer section placed before the surface-sizing device can be made shorter while maintaining the drying capacity, so that the surface-sizing device and the finishing-dryer can be arranged after the shorter dryer section in place of the previous dryer section before the machine reel-up, which must be allowed to stay in its previous, existing location.

In view of achieving the objects stated above and others, in the invention, with a view toward optimizing the drying capacity calculated per unit of length of the dryer section in the machine direction, as the drying makes progress, a different ratio $k=D/d$ of the drying cylinder diameter D to the reversing-roll diameter d is employed. As such, in the first group or groups in the initial end of the dryer section, the ratio $k=k_1$ is higher than the ratio $k=k_2$ in the groups in the middle area of the dryer section, $k_1>k_2$. Moreover, in the group or groups in the final end of the dryer section, a diameter ratio $k_3$ is used that is higher than the ratio $k_2$ used in the groups in the middle area of the dryer section, $k_3>k_2$.

In the present invention, as the web progress through the dryer section, the diameter ratio D/d of drying cylinder to reversing roll is selected to be optimal in view of the different evaporation curves that are realized in the different areas in the dryer section.

According to the invention, in the initial end of the dryer section, preferably in one group, the diameter ratio D/d that is used is higher than average, compared with the middle area of the dryer section, for example, in the second, third and fourth wire groups. These wire groups are placed in the area in which the principal evaporation of water takes place from the web. According to the invention, a higher diameter ratio D/d is also employed in the final end of the dryer section, in which a significant proportion of the evaporation takes place on the curve sectors of the wire and the web on the drying cylinders.

Furthermore, in accordance with the invention, as a result of the optimally selected and variable diameter ratio $k=D/d$ of drying cylinder to reversing roll, the length of the dryer section can be shortened, at the maximum, by about 10 per cent in comparison with a situation in which the ratio k is substantially constant over the entire length of the dryer section.

It is an important advantage of the invention that, even if different cylinder diameters are used, the drying cylinders and the reversing cylinders can, however, be placed in such a way in horizontal rows that the dryer section can be operated from one tending platform, which is an essential advantage compared with the so-called vertical dryers. Of course, the arrangement in accordance with the present invention can also be applied to these so-called vertical dryers in order to reduce the space required.

In a preferred embodiment of the invention, a larger diameter of the drying cylinder is employed in the last group, whereby an additional advantage is obtained in that a more symmetric drying of the paper web from the opposite sides of the web is accomplished. This results because on the face of the larger-diameter drying cylinder, the relative proportion of the evaporation taking place at the top side is increased as the web becomes dry.

In the method for drying a web in a dryer section in accordance with the invention, the web is passed through at least one initial single-wire draw cylinder group including smooth-faced heated drying cylinders against which the web to be dried enters into direct contact, a reversing roll situated between each adjacent pair of the drying cylinders, guide rolls, and a drying wire for carrying the web while being guided in a loop by the guide rolls, the drying cylinders and the reversing rolls. The web is then passed from the forwardmost initial group to at least one intermediate single-wire draw cylinder group including smooth-faced heated drying cylinders against which a web to be dried enters into direct contact, a reversing roll situated between each adjacent pair of the drying cylinders, guide rolls, and a drying wire for carrying the web while being guided in a loop by the guide rolls, the drying cylinders and the reversing rolls. From the forwardmost intermediate group, the web is passed to at least one final single-wire draw cylinder group including smooth-faced heated drying cylinders against which a web to be dried enters into direct contact, a reversing roll situated between each adjacent pair of the drying cylinders, guide rolls, and a drying wire for carrying the web while being guided in a loop by the guide rolls, the drying cylinders and the reversing rolls. The ratio of the diameter of the drying cylinders to the diameter of the reversing rolls is varied between the groups. Preferably, the diameter ratio of the initial group(s) is greater that the diameter ratio of the intermediate group(s) and the diameter ratio of the final group(s) is greater that the diameter ratio of the intermediate group(s). The diameter ratios of the initial group(s), the intermediate group(s) and the final group(s) are selected relative to the rate of evaporation of water from the web in the respective group(s).

In the following, the invention will be described in detail with reference to some exemplifying embodiments of the invention illustrated schematically in the figures in the accompanying drawing. However, the invention is in no way strictly confined to the details of these exemplifying embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
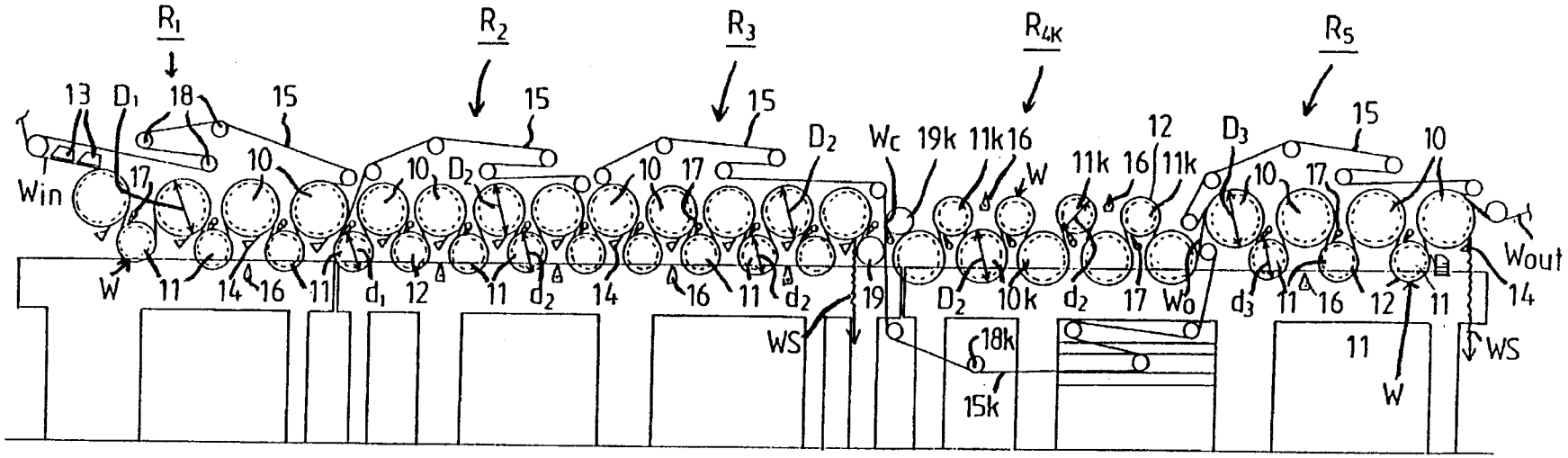
FIG. 1 is a side view of a dryer section in accordance with the invention and in which the method in accordance with the invention is applied.

As shown in FIG. 1, a paper web $W_{in}$ is passed to a dryer section in accordance with the invention from a press section (not shown) onto a drying wire 15 of a first dryer group with single-wire draw $R_1$. The web adheres to wire 15 by the effect of the negative pressure produced by blow boxes 13 or other suitable adhesion means. In FIG. 1, all the groups $R_1, \ldots, R_5$ are single-wire groups, and the groups $R_1, R_2, R_3$ and $R_5$ are so-called normal groups, in which, for example, steam-heated smooth-faced drying cylinders 10 are placed in an upper horizontal row, and reversing suction rolls 11 are placed in a lower horizontal row. In FIG. 1, the fourth group $R_{4k}$ is a so-called inverted group in which drying cylinders **10*k* are placed in a lower horizontal row and reversing rolls 11*k* are placed in an upper horizontal row, and a drying wire 15*k* runs below the dryer section guided by a guide roll 18*k***. However, it is pointed out in this connection that the invention can also be applied so that, in the place of the inverted group there is a normal group $R_4$ having a similar construction as groups $R_1, R_2$ and $R_3$.

Each normal group $R_1, R_2, R_3$ and $R_5$ has a separate drying wire 15 which is guided by guide rolls 18. In each group, the drying wire 15 presses the web W to be dried on the drying cylinders 10 against their smooth heated faces, and on the reversing rolls 11 the web W remains at the side of the outside curve on the outer face of the wire 15. On the reversing rolls 11, the web W is kept reliably on support of the wire 15 against the effects of centrifugal forces by the effect of the negative pressure present in the grooved faces 12 of the reversing cylinders 11, whereby transverse shrinkage of the web W is also counteracted. The reversing rolls 11 used are preferably suction cylinders marketed under the trade mark "VAC-ROLL"™, which cylinders have no inside suction boxes and with respect to the details of whose constructions reference is made to Finnish Patent No. 83,680. However, it should be emphasized that the scope of the invention also includes dryer sections in which, in the positions of the reversing rolls 11, traditional suction rolls provided with an inside suction box are used. Between adjacent reversing rolls 11, ventilation blow pipes 16 are provided and in a group gap between a normal group and an inverted group, a wire roll 19 is arranged.

In a preferred embodiment of the invention, the support contact between the web W and the drying wire 15 is also kept adequate on the straight runs between the drying cylinders **10,10*k* and the reversing rolls 11, at least on the runs from the drying cylinders 10 to the reversing rolls 11,11*k*, by employing blow-suction boxes 17. By means of blow-suction boxes 17, the formation of pressure induced by the wire 15,15*k* is prevented in the closing wedge-shaped nip spaces between the wire 15,15*k* and the roll 11 mantles. With respect to the details of the constructions of these blow-suction boxes 17, which are marketed under the trade mark "UNO RUN BLOW BOX"™, reference is made to Finnish Patent Nos. 59,637, 65,460 and 80,491 (corresponding to U.S. Pat. Nos. 4,441,263, 4,516,330 and 4,905,380, respectively, the specifications of which are hereby incorporated by reference herein). After the introduction of the "UNO RUN BLOW BOX"™, the assignee's competitors have also suggested some constructions of blow boxes, with respect to which reference is made to U.S. Pat. Nos. 4,502,231 (assigned to J. M. Voith GmbH) and 4,661,198 (assigned to Beloit Corp.), the applications of these blow boxes in the positions of the blow boxes 17** being also included in the scope of the overall concept of the present invention, and so also dryer sections in which these blow boxes are not used.

In the single-wire groups $R_1, \ldots, R_5$, if necessary, blow boxes 16 can be provided in the gaps between the reversing rolls **11,11*k*, by means of which boxes, the intermediate spaces are air-conditioned and evaporation from the web W is promoted. The faces of the drying cylinders 10,10*k* are kept clean by the doctors 14**.

In the normal groups $R_1, R_2, R_3$ and $R_5$ with single-wire draw as shown in FIG. 1, removal of broke by the force of gravity can be applied, for the single-wire groups $R_1, R_2, R_3$ and $R_5$ are open toward the bottom so that the paper web WS that becomes broke can be removed without any special arrangements onto the broke conveyor (not shown) placed in the basement space of the paper machine. In the inverted group $R_{4k}$, the removal of broke by the force of gravity cannot be applied, but rather, in the group $R_{4k}$, devices in themselves known for transverse shifting of the broke must be arranged. As mentioned previously, the inverted group $R_{4k}$ can be substituted for by a normal group $R_4$, in which case removal of broke by the force of gravity can be applied over the entire length of the dryer section.

In the final end of the dryer section, as the last $R_N$ or second-to-last (penultimate) wire group $R_{N-1}$, there may be one single group with twin-wire draw. In this single twin-wire group, there are two horizontal rows of contact-drying cylinders placed one row above the other, an upper wire being provided in connection with the upper cylinders, which wire is guided by wire guide rolls arranged in gaps between the cylinders and by other guide rolls. The web W is pressed into drying contact against the heated faces of the lower cylinders by the lower wire, which is guided by wire guide rolls arranged in gaps between the cylinders and by other guide rolls.

The dryer section comprises N groups $R_1, \ldots, R_N$ with single-wire draw, in whose group gaps the web W has closed draws. In a dryer section in accordance with the invention, the number N of normal groups $R_{1, \ldots, N}$ is about 5 to 9, preferably N is 6 to 8, and typically N is 7.

In the present invention, with a view toward achieving a maximum drying capacity per unit of length of the dryer section in the machine direction, the ratio k=D/d of the diameters D of the drying cylinders 10,10*k* to the diameters d of the reversing rolls 11,11*k* is selected to be different in different parts of the dryer section, because the drying processes are different with different dry solids contents ka, as will be described in more detail later with reference to FIGS. 2 and 3A,3B,3C. In the invention, the ratio k=D/d is selected so that, in the first group $R_1$ in the initial end of the dryer section or in several groups $R_1, \ldots, R_N$ in the initial end of the dryer section, the ratio $k=k_1$ is employed and is higher than the corresponding ratio in the groups in the middle area of the dryer section wherein the ratio is $k=k_2$, i.e., $k_1>k_2$. In the invention, in the group $R_N$ or groups in the final end, a ratio of diameters $k_3$ is used that is higher that the above ratio $k_2$, i.e., $k_3>k_2$. Preferably, in the present invention, the ratios are selected so that $k_1 \geqq k_3>k_2$. In some applications, it is preferable to selected $k_1$ to be substantially equal to $k_3$ as shown in FIG. 1B. In the invention, preferably just two different diameters D of the drying cylinders and just one or two diameters d of the reversing rolls 11,11*k* are employed.

In the following, some preferred examples of dimensioning of the diameters D and d as well as corresponding examples of dimensioning of the ratios of the diameters k=D/d will be given:

D=from about 1500 mm to about 2500 mm, preferably from about 1800 mm to about 2400 mm;

d=from about 600 mm to about 1800 mm, preferably from about 1000 mm to about 1500 mm;

$k_1=D_1/d_1$=from about 1.2 to about 4, preferably from about 1.4 to about 3;

$k_2=D_2/d_2$=from about 1 to about 3.5, preferably from about 1.2 to about 2.75; and $k_3=D_3/d_3$=from about 1.2 to about 4, preferably from about 1.4 to about 3.5.

The ranges of ratios given above serve just as a guideline, because they depend on the diameter d of the reversing roll 11,11*k* to a great extent.

A second mode of defining the optimal choices of ratios k of diameters in accordance with the present invention is to select the relative ratios of the ratios $k_1$, $k_2$ and $k_3$ as follows:

$k_1/k_2$=from about 1.2 to about 2, preferably from about 1.2 to about 1.6; and $k_3/k_2$=from about 1.2 to about 2, preferably from about 1.2 to about 1.8.

Typically, according to the invention, in the first single-wire group the diameter $D_1$ of the drying cylinders is about 2200 mm, and the diameter $d_1$ of the reversing rolls is about 1200 mm. In the middle area of the dryer section, for example in the groups $R_2, \ldots, R_4$, the diameter $D_2$ of the drying cylinders is about 1800 mm, and the diameter $d_2$ of the reversing rolls is about 1500 mm. In the final end of the dryer section, for example in the groups $R_5, \ldots, R_7$, the diameter $D_3$ of the drying cylinders is about 2200 mm, and the diameter $d_3$ of the reversing rolls is about 1500 mm. In this example of dimensioning, an advantage is obtained that only two different diameters $D_1$ and $D_2$ of the drying cylinders 10 and two different diameters $d_1$ and $d_2$ of the reversing rolls are needed. Preferably, the ratio D/d of diameters is at a maximum in the beginning of the dryer section and at a minimum around the middle of the dryer section.

Figure 1A:
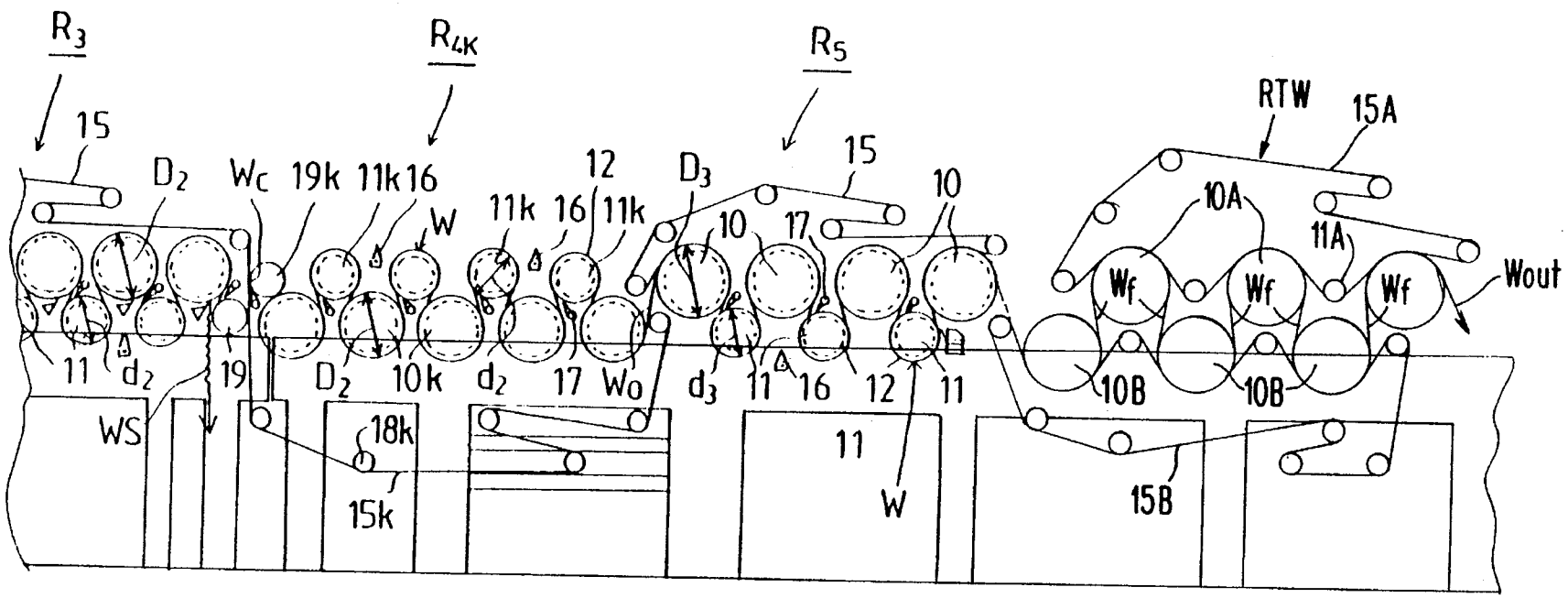
FIG. 1A is a side view of an alternative embodiment of a dryer section in accordance with the invention and in which the method in accordance with the invention is applied.
Figure 1B:
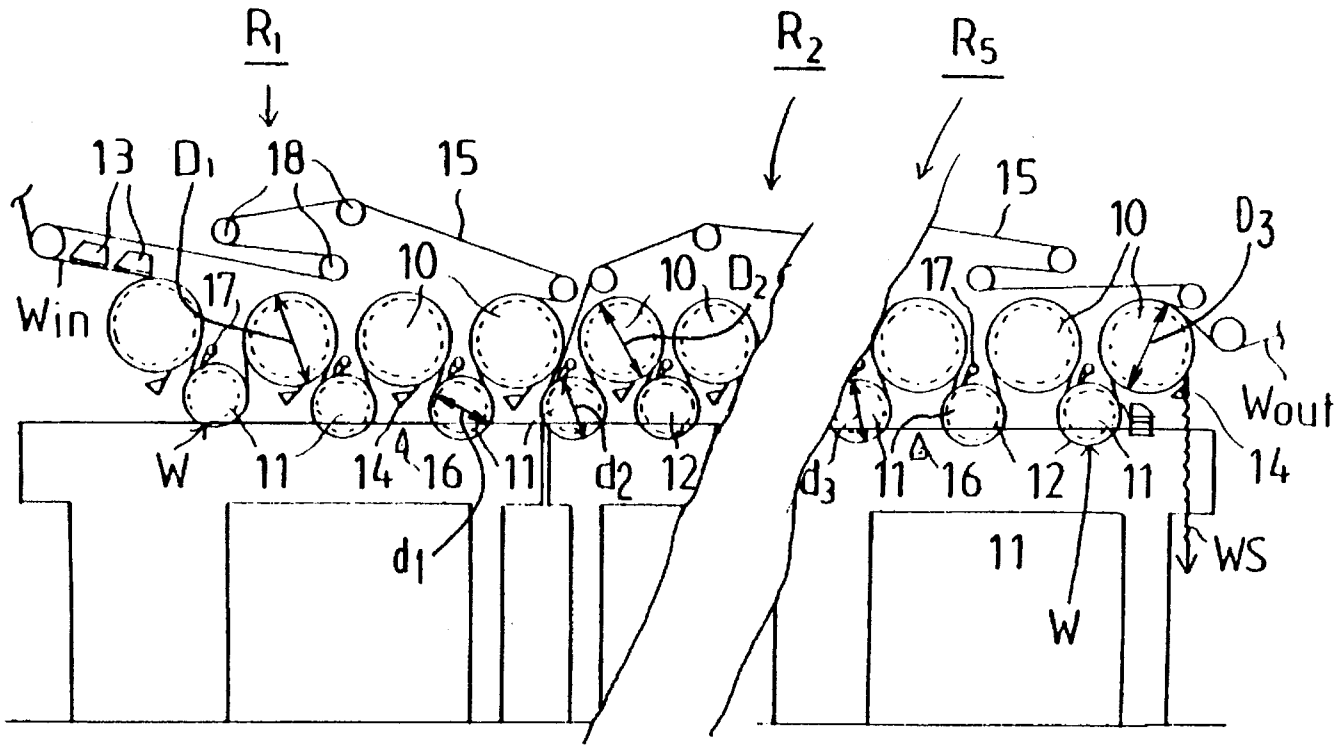
FIG. 1B is an enlarged side view of the embodiment of a dryer section as shown in FIG. 1 showing the first, second and last dryer groups.

The dryer section shown in FIG. 1A is similar to that shown in FIG. 1 but has a dryer group with twin-wire draw $R_{TW}$ arranged at the final end of the dryer section as the last dryer group of the dryer section. The twin-wire draw group $R_{TW}$ may also be the penultimate dryer group of the dryer section if so desired. In the twin-wire draw group $R_{TW}$, there are two rows of drying cylinders 10A,10B, wire guide rolls 11A situated between adjacent ones of the drying cylinders 10A,10B in each of the two rows and two drying wires 15A,15B for carrying the web over the wire guide rolls 11A into contact with the drying cylinders 10A,10B in a respective one of the two rows. The web has free, unsupported draw $W_f$ between the two rows of drying cylinders 10A,10B.

In the following, with reference to FIGS. 2, 3A, 3B and 3C, those facts which are related to the rate of evaporation on which the favorable effects of the present invention are based will be described.

Figure 2:
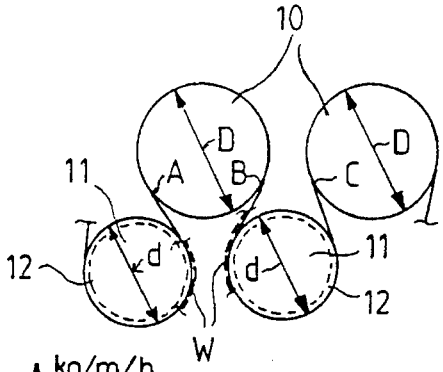
FIG. 2 illustrates successive pairs of drying cylinders and reversing rolls, in connection with which the different drying portions A–B and B–C are denoted, these denotations referring to the corresponding denotations in FIGS. 3A, 3B and 3C.
Figure 3A:
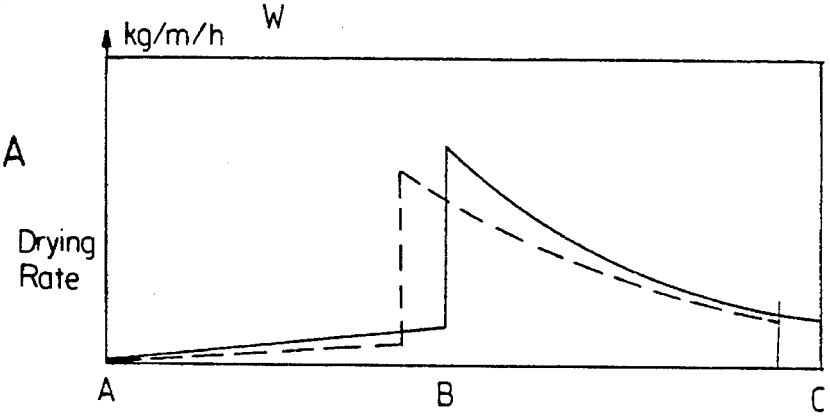
FIGS. 3A, 3B and 3C illustrate water evaporation rates out of the web that are achieved with the different drying portions as shown in FIG. 2.
Figure 3B:
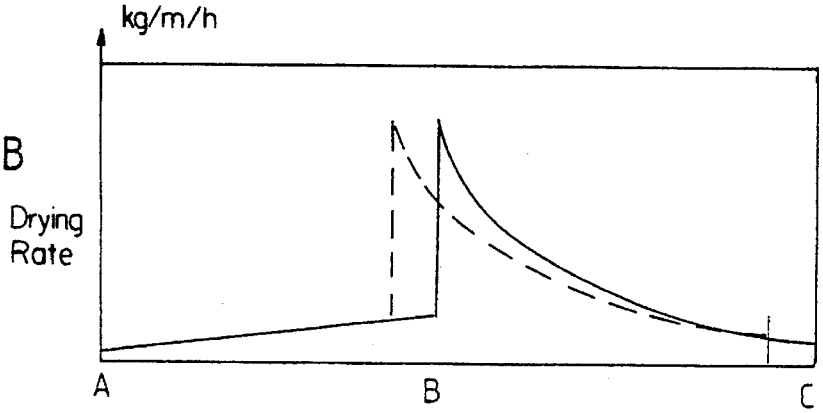
Figure 3C:
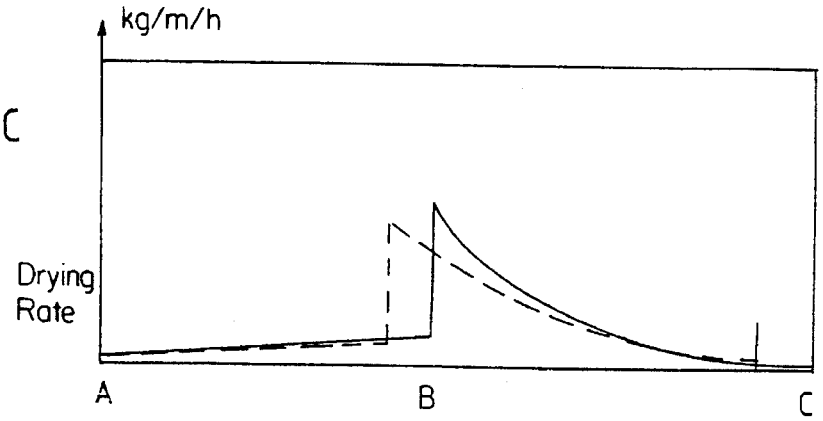

In FIGS. 3A, 3B and 3C, the rates of evaporation are compared between the points A and C shown in FIG. 2 (A=arrival on the cylinder 10, B=departure from the cylinder 10, and C=arrival on the next cylinder 10). The curves in FIGS. 3A, 3B and 3C are based on computer simulation. The curve drawn with a solid line represents a case in which the diameter D of the cylinder 10 is about 2200 mm and the diameter d of the reversing roll, such as a VAC-ROLL™, is about 1500 mm The curve drawn with a dashed line represents a case in which the diameter D of the cylinder 10 is normal, i.e., about 1830 mm, and the diameter d of the reversing roll is about 1500 mm. The overall evaporation of water out of the web W is represented by the area that remains below the curves between the points (A–C). It should also be noted that the dashed line ends earlier, because in this case the web W runs over a shorter distance. The steam pressures and the other conditions are similar to those in a normal newsprint machine with different dry solids contents (web W=newsprint having a dry solids content of 45 g/m$^2$, machine speed of about 1500 m/min).

In FIGS. 3A, 3B and 3C, it is assumed that the dryer-section geometries to be compared differ from one another in respect of the diameter D of the cylinders 10 only, i.e., the distance between the cylinders remains invariable and about 270 mm. With the larger cylinder diameter, D=2200 mm, a cylinder-roll pair 10,11 takes (2470-2100)/2100=18% more space in the longitudinal direction.

In FIG. 3A, the dry solids content ka of the web W is about 45%, i.e. in the beginning of the dryer section, a pair of large diameter (D=2200 mm) drying cylinder in conjunction with reversing rolls 10,11 evaporates 56% more water than a conventional arrangement over a distance that is only 18% longer, which is an advantageous arrangement in view of the drying capacity.

In FIG. 3B, the dry solids content ka of the web W is about 65%, so that the operation takes place around the middle of the dryer section, a pair of large diameter (D=2200 mm) drying cylinder in conjunction with reversing rolls 10,11 evaporates 12% more water than a conventional arrangement from the web over a distance that is 18% longer, from which it can be concluded that the smaller diameter (D=1830) cylinder 10 provides larger evaporation per meter of length of the machine.

In FIG. 3C, the dry solids content ka of the web W is about 85%, so that the operation takes place in the final end of the dryer section, a pair of large diameter (D=2200 mm) drying cylinder in conjunction with reversing rolls 10,11 evaporates 20% more water than a conventional arrangement from the web over a distance that is 18% longer, which is advantageous in view of the drying capacity.

In a preferred embodiment of the invention, the highest ratio $k_1$ of diameters mentioned above, which can be $k_1=k_3$, is employed at the stage in the drying process in which the dry solids content $ka_1$ of the web W is in the range of from about 40% to about 65%, and the lowest ratio $k_2$ of diameters is employed in the area in which the dry solids content $ka_2$ of the web W is in the range of from about 65% to about 85%, and the third ratio $k_3$ of diameters is employed in the range of dry solids content $ka_3$ of the web W of about 85%.

When a relatively larger cylinder diameter $D_3$ is employed in the last group $R_N$, as an additional advantage a more symmetric drying of the paper web W from both sides of the web is obtained, for the proportion of the evaporation taking place upwards on the face of the cylinder 10 is increased as the web W becomes dry.

The examples provided above are not meant to be exclusive. Many other variations of the present invention would be obvious to those skilled in the art, and are contemplated to be within the scope of the appended claims.

We claim:

1. A dryer section of a paper machine, comprising at least one initial single-wire draw cylinder group situated at an initial end of the dryer section in a direction of web travel through the dryer section, said at least one initial group comprising smooth-faced heated drying cylinders having a diameter $D_1$ against which a web to be dried enters into direct contact, a reversing roll having a diameter $d_1$ situated between each adjacent pair of said drying cylinders, guide rolls, and a drying wire for carrying the web while being guided in a loop by said guide rolls, said drying cylinders and said reversing rolls;

at least one final single-wire draw cylinder group situated at a final end of the dryer section in the direction of web travel, said at least one final group comprising smooth-faced heated drying cylinders having a diameter $D_3$ against which a web to be dried enters into direct contact, a reversing roll having a diameter $d_3$ situated between each adjacent pair of said drying cylinders, guide rolls, and a drying wire for carrying the web while being guided in a loop by said guide rolls, said drying cylinders and said reversing rolls;

at least one intermediate single-wire draw cylinder group situated between said at least one initial group and said at least one final group, said at least one intermediate group comprising smooth-faced heated drying cylinders having a diameter $D_2$ against which a web to be dried enters into direct contact, a reversing roll having a diameter $d_2$ situated between each adjacent pair of said drying cylinders, guide rolls, and a drying wire for carrying the web while being guided in a loop by said guide rolls, said drying cylinders and said reversing rolls;

the ratio $k_1$ of the diameter $D_1$ of said drying cylinders to the diameter $d_1$ of said reversing rolls being greater than the ratio $k_2$ of the diameter $D_2$ of said drying cylinders to the diameter $d_2$ of said reversing rolls; and the ratio $k_3$ of the diameter $D_3$ of said drying cylinders to the diameter $d_3$ of said reversing rolls being greater than the ratio $k_2$ of the diameter $D_2$ of said drying cylinders to the diameter $d_2$ of said reversing rolls.

2. The dryer section of claim 1, wherein the ratio $k_1$ of a first one of said groups at the initial end of said dryer section is the highest diameter ratio of said groups in said dryer section.

3. The dryer section of claim 1, wherein the diameter ratio $k_1$ is substantially equal to the diameter ratio $k_3$.

4. The dryer section of claim 1, wherein in at least one of said groups, said drying cylinders and said reversing rolls have a different diameter that the respective diameter of said drying cylinders and said reversing rolls in the remainder of said plurality of groups.

5. The dryer section of claim 1, wherein the diameter $D_1$ of said drying cylinders is substantially equal to the diameter $D_3$ of said drying cylinders, the diameter $d_2$ of said reversing rolls is substantially equal to the diameter $d_3$ of said reversing rolls, and the diameter $d_1$ of said reversing rolls is smaller than the diameter $d_2$ of said reversing rolls and the diameter $d_3$ of said reversing rolls.

6. The dryer section of claim 1, wherein the diameters $D_1$, $D_2$, $D_3$ of said drying cylinders is from about 1500 mm to about 2500 mm, and the diameters $d_1$, $d_2$, $d_3$ of said reversing rolls is from about 600 mm to about 1800 mm.

7. The dryer section of claim 1, wherein the diameters $D_1$, $D_2$, $D_3$ of said drying cylinders is from about 1800 mm to about 2400 mm, and the diameters $d_1$, $d_2$, $d_3$ of said reversing rolls is from about 1000 mm to about 1500 mm.

8. The dryer section of claim 1, wherein the diameter ratio $k_1$ is from about 1.2 to 4, the diameter ratio $k_2$ is from about 1 to 3.5, and the diameter ratio $k_3$ is from about 1.2 to 4.

9. The dryer section of claim 1, wherein the diameter ratio $k_1$ is from about 1.4 to 3, the diameter ratio $k_2$ is from about 1.2 to 2.75, and the diameter ratio $k_3$ is from about 1.4 to 3.5.

10. The dryer section of claim 1, wherein the ratio of the diameter ratio $k_1$ to the diameter ratio $k_2$ is from about 1.2 to 2, the ratio of the diameter ratio $k_3$ to the diameter ratio $k_2$ is from about 1.2 to 2.

11. The dryer section of claim 1, wherein the ratio of the diameter ratio $k_1$ to the diameter ratio $k_2$ is from about 1.2 to 1.6, the ratio of the diameter ratio $k_3$ to the diameter ratio $k_2$ is from about 1.2 to 1.8.

12. The dryer section of claim 1, wherein a first one of said groups in the web travel direction is a normal group with single-wire draw in which said drying cylinders are arranged in a first horizontal row and said reversing rolls are arranged in a second horizontal row below said first row, the diameter of said drying cylinders in said normal group being about 2200 mm, and the diameter of said reversing rolls in said normal group being about 1200 mm, and in a second, third and fourth one of said groups following said first group in the web travel direction, the diameter of said drying cylinders is about 1800 mm and the diameter of said reversing rolls is about 1500 mm, and in a fifth one of said groups situated at the final end of the dryer section, the diameter of said drying cylinders is about 2200 mm, and the diameter of said reversing rolls is about 1500 mm.

13. The dryer section of claim 1, wherein said plurality of groups comprises between 4 and 9 normal groups with single-wire draw in which said drying cylinders are arranged in a first horizontal row and said reversing rolls are arranged in a second horizontal row below said first row.

14. The dryer section of claim 1, wherein in each of said groups, said drying cylinders and said reversing rolls are situated in a respective horizontal level, said drying cylinders in said groups being situated substantially in the same horizontal level, and said reversing rolls in said groups being situated substantially in the same horizontal level.

15. The dryer section of claim 1, wherein the web has closed draws between adjacent ones of said groups.

16. The dryer section of claim 1, further comprising a dryer group with twin-wire draw arranged at the final end of the dryer section, as the last dryer group of the dryer section, said twin-wire draw group having two rows of drying cylinders, wire guide rolls situated between adjacent ones of said drying cylinders in each of said two rows and two drying wires for carrying the web over said reversing rolls into contact with said drying cylinders in a respective one of said two rows.

17. The dryer section of claim 1, wherein said at least one initial group is arranged in an area in which the dry solids content of the web is from about 40% to about 65%, said at least one intermediate group is arranged in an area in which the dry solids content of the web is from about 65% to about 85%, and said at least one final group is arranged in an area in which the dry solids content of the web is greater than about 85%.

18. The dryer section of claim 1, wherein one of said groups is an inverted group in which said drying cylinders are arranged in a first horizontal row and said reversing rolls arranged in a second horizontal row above said first row, said inverted group being arranged as the penultimate group in the dryer section.

19. A method for drying a web in a dryer section, comprising the steps of passing the web through at least one initial single-wire draw cylinder group comprising smooth-faced heated drying cylinders against which the web to be dried enters into direct contact, a reversing roll situated between each adjacent pair of said drying cylinders, guide rolls, and a drying wire for carrying the web while being guided in a loop by said guide rolls, said drying cylinders and said reversing rolls;

passing the web from said at least one initial group to at least one intermediate single-wire draw cylinder group comprising smooth-faced heated drying cylinders against which a web to be dried enters into direct contact, a reversing roll situated between each adjacent pair of said drying cylinders, guide rolls, and a drying wire for carrying the web while being guided in a loop by said guide rolls, said drying cylinders and said reversing rolls;

passing the web from said at least one intermediate group to at least one final single-wire draw cylinder group comprising smooth-faced heated drying cylinders against which a web to be dried enters into direct contact, a reversing roll situated between each adjacent pair of said drying cylinders, guide rolls, and a drying wire for carrying the web while being guided in a loop by said guide rolls, said drying cylinders and said reversing rolls;

varying the ratio of the diameter of said drying cylinders to the diameter of said reversing rolls between said groups;

selecting the diameter ratio of said at least one initial group to be greater that the diameter ratio of said at least one intermediate group; and selecting the diameter ratio of said at least one final group to be greater that the diameter ratio of said at least one intermediate group.

20. The method of claim 19, further comprising the step of selecting the diameter ratio of said at least one initial group, said at least one intermediate group and said at least one final group relative to the rate of evaporation of water from the web in said at least one initial group, said at least one intermediate group and said at least one final group, respectively, to maximize the drying capacity thereof.

21. The dryer section of claim 1, wherein the web has open draws between adjacent ones of said groups.

* * * * *